United States Patent [19]

Morrelli

[11] Patent Number: 5,001,999

[45] Date of Patent: Mar. 26, 1991

[54] MAST BRACE FOR A WINDSURFER

[76] Inventor: Vincent A. Morrelli, 3953 Transport St., Ventura, Calif. 90003

[21] Appl. No.: 493,758

[22] Filed: Mar. 15, 1990

[51] Int. Cl.[5] ..... B63H 9/08

[52] U.S. Cl. ..... 114/39.2; 114/97

[58] Field of Search ..... 114/39.1, 39.2, 89, 114/90, 91, 92, 93, 101, 102

[56] References Cited

U.S. PATENT DOCUMENTS

| | | | |
|---|---|---|---|
| 4,458,859 | 7/1984 | Ganev | 114/39.2 |
| 4,473,022 | 9/1984 | Eastland | 114/39.2 |
| 4,922,845 | 5/1990 | Boyd | 114/39.2 |

FOREIGN PATENT DOCUMENTS

| | | | |
|---|---|---|---|
| 3622849 | 1/1988 | Fed. Rep. of Germany | 114/39.2 |
| 2480703 | 10/1981 | France | 114/39.2 |

*Primary Examiner*—Sherman D. Basinger
*Assistant Examiner*—Stephen P. Avila
*Attorney, Agent, or Firm*—Jack C. Munro

[57] ABSTRACT

A mast brace for a windsurfer which takes the form of a cord which is adjustable in length. The mast brace is to be adjustable to various desired degrees of tautness to decrease the amount of lateral bending of the mast that occurs when wind pressure is applied to the sail body. This mast brace extends between the tip of the mast and the boom which extends between the luff edge and the leech edge of the sail body.

2 Claims, 1 Drawing Sheet

LONGITUDINAL STRIPE

10
A
LATERAL STRIPE

SMOOTHED DATA
UPPER CLOTH
FEED DISTANCE

DIFFERENTIATED DATA
UPPER CLOTH
FEED DISTANCE
LONGITUDINAL STRIPE

12
A
LATERAL STRIPE

SMOOTHED DATA
LOWER CLOTH
FEED DISTANCE

DIFFERENTIATED DATA
LOWER CLOTH
FEED DISTANCE
UPPER CLOTH

1
LOWER CLOTH
SUPERPOSED DIFFERENTIATED DATA
FEED DISTANCE

MAST BRACE FOR A WINDSURFER

BACKGROUND OF THE INVENTION

The field of this invention relates to crafts that move on water and more particularly to a brace for the mast of a windsurfer.

There is in common use a recreational vehicle for water which is called a windsurfer. A windsurfer generally comprises a sail which is mounted on a single mast which in turn is pivotally mounted by a universal joint on a surfboard. When sailing the windsurfer, a person stands on the board next to the sail and holds onto an oval boom which surrounds the mast and the sail. The windsurfer is controlled by a combination of body movements on the surfboard, body leaning and sail positioning.

Within windsurfers, it is important that the single sail provide maximum aerodynamic effect to provide for optimum efficiency and speed. At the present time, there is an intense competition between manufacturers to be able to state that a particular manufacturer has "the fastest windsurfer". Therefore, the design of sails, masts and rigging within the windsurfing industry has been the subject of intense development and innovation. As a result of this intense development and innovation, the maximum windsurfer speed has increased from approximately twenty knots to around forty knots over the last several years.

When the sail body of a windsurfer encounters the wind, the sail body billows. This "capturing of the wind" produces the force which drives the windsurfer. The mast is cantilevered relative to the sailboard. This means that the outer end or tip of the mast is free (not attached). This billowing of the sail body produces a lateral bending of the mast relative to the sailboard. It has been found that the greater the bend the greater the loss of efficiency and therefore the lower the speed of the windsurfer. Up to the present time, the only way to compensate for bending of the mast is to make the mast laterally as rigid and strong as possible. Most masts are constructed of a metallic material such as aluminum. No matter how strong the mast is made, inherently there is going to be some bending. The bending has to occur because the mast is cantilevered.

SUMMARY OF THE INVENTION

The structure of the present invention is to provide for a brace which decreases the amount of lateral bending of the mast during operation of the windsurfer.

Each windsurfer is operated by the sailor through the use of a boom. The boom comprises an oval shaped rigid member which encompasses the sail body and the mast. This boom is located generally about three to four feet above the upper surface of the sailboard with the total sail body height being in the range of twelve to fourteen feet. The main portion of the bending of the mast occurs above the boom. Therefore, if the tip of the mast is lashed to the boom, the bending is substantially decreased. Lashing of the tip of the mast to the boom is accomplished through a cord. This cord is initially adjusted to its approximate desired length (depending upon the height of the particular mast) by a line adjuster which is mounted within the cord of the mast brace. The lower end of the mast brace is connected through a buckle assembly to the boom. The connection to the boom is to be within the general center area of the boom between the luff edge and the leech edge of the sail body. The buckle is to be manually adjustable to various degrees of tautness of the cord to thereby vary the amount of bending of the mast. The less the mast bends, the harder it is to control the windsurfer. Therefore, generally, the more experienced sailor will increase the tautness of the mast brace so that the windsurfer will function more efficiently. The less experienced sailor will permit the mast to bend to a greater degree and although the windsurfer will operate less efficiently, it will be easier to control.

An objective of the present invention is to construct a brace for the mast of a windsurfer which is constructed of few parts, can be installed simply with a minimum amount of skill and can be manufactured inexpensively and therefore sold to the consumer at a relatively inexpensive price.

The primary objective of the present invention is to construct a mast brace which will cause the overall efficiency of a windsurfer to be increased thereby increasing the maximum speed of operation of the windsurfer.

DETAILED DESCRIPTION OF THE SHOWN EMBODIMENT

Figures 7A, 7B, 7C, 7D, 7E, 7F, 7G:
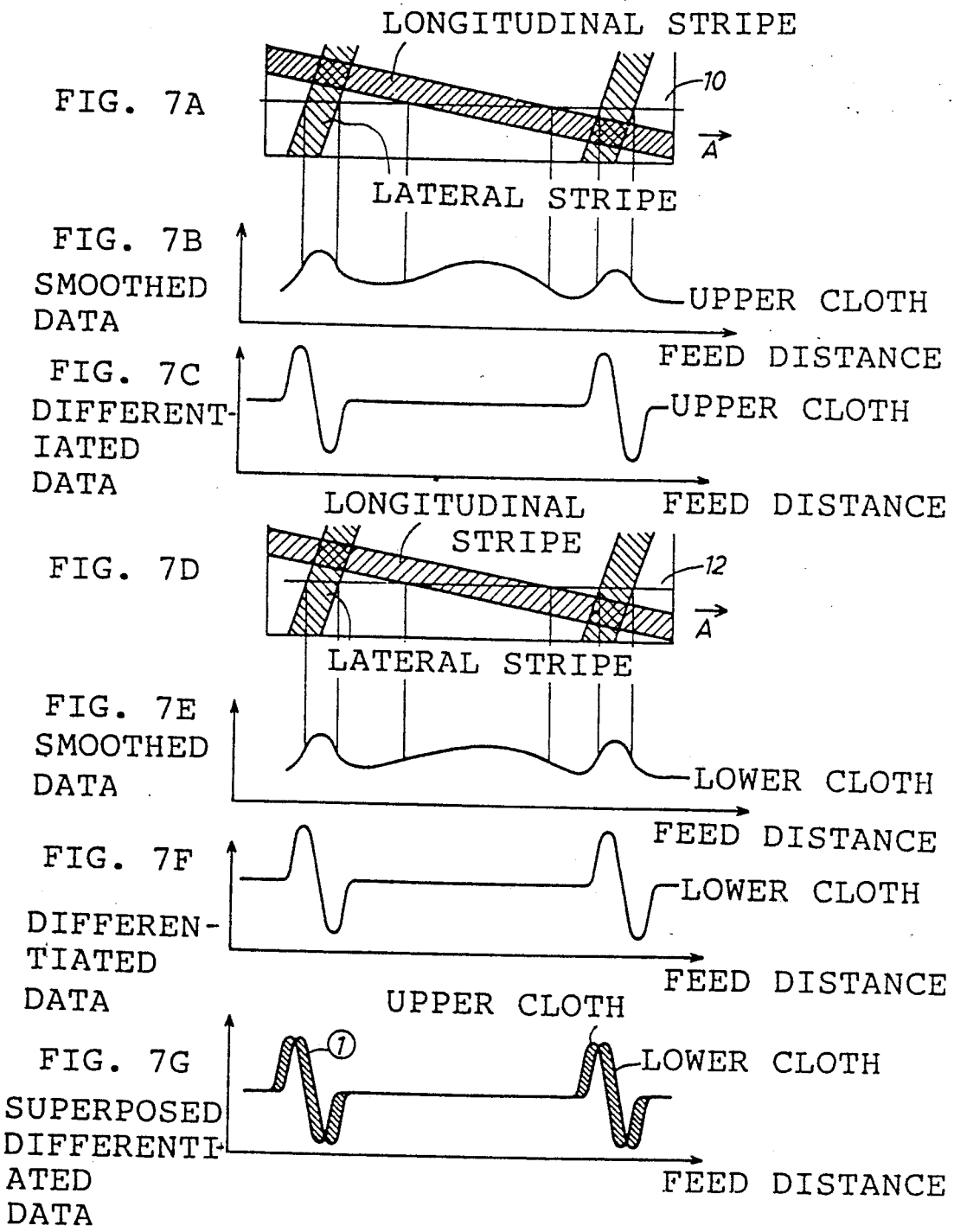

Referring particularly to the drawing, there is shown a conventional windsurfer 10 which is constructed of a sailboard 12 which has a bottom surface 14 which is to ride on the surface of the water (not shown), and an upper surface 16 upon which is to be located the sailor (operator) of the windsurfer 10 with this sailor not being shown. Mounted on the upper surface 16 of the sailboard 12 by means of a universal joint 18 is a mast 20. The mast 20 is conducted through a tubular section 22 of the sail body 24 with this tubular section 22 being located at the luff edge 26 of the sail body 24. The rear (downstream) edge of the sail body 24 is defined as the leech edge 28. The free or upper end of the mast 20 terminates in a tip 30. At the tip 30 there is located a support strap 32 which is to strengthen the uppermost portion of the sail body and its connection to the mast 20.

About three to four feet above the upper surface 16 and located directly adjacent the leech edge 28 is an eyelet 34. Connecting with the eyelet 34 is a tie-down strap 36. The tie-down strap 36 is connected to a tubular rigid member which is defined as a boom 38. This boom is basically oval shaped and surrounds the sail body and the mast 20. There is a connection between the boom 38 and the mast 20 with this connection not being shown.

It is to be understood that boom 38 is to be graspable by the sailor on either the starboard side of the sail body 24 or the port side of the sail body 24. This boom 38 assumes a bowed configuration relative to both the port side and the starboard side. This bowing of the boom 38 is such that in the area of handle 40 the boom 38 is located furthest from the sail body 24 when the sail body 24 is at an at-rest position. The handle 40 is basically bifurcated forming a pair of legs with these legs being pivotally mounted on the boom 38. It is between these pairs of legs that the buckle strap 42 of the mast brace 44 of this invention is attached to the boom 38.

The buckle strap 42 is formed into a loop 46 at its outer end thereof which surrounds the tubular boom 38. The opposite end of the buckle strap 42 connects with a buckle 48. This buckle 48 connects with a short strap 50. The buckle 48 provides for a slip connection which is capable of frictionally binding together the buckle strap 42 and prevent any adjusting movement of the buckle strap 42 and hence the mast brace 44. However, the buckle 48 can be tilted which will permit slippage of the buckle strap 42 and hence loosening of the mast brace 44.

The short strap 50 includes a loop 52 through which is conducted cord 54. One end of cord 54 is passed through hole 56 of a line adjuster 58. The remaining end of the cord 54 is also conducted through the hole 56 and then is wrapped around narrowed down section 60 of the line adjuster 58 with the free outermost end of the cord 54 to then be conducted again through the hole 56. This cord 54 then continues through a hole 62 formed within line adjuster 58 and then terminates in a cord loop 64 which is placed around the tip 30 of the mast 20.

Figures 1, 2, 3, 4, 5:
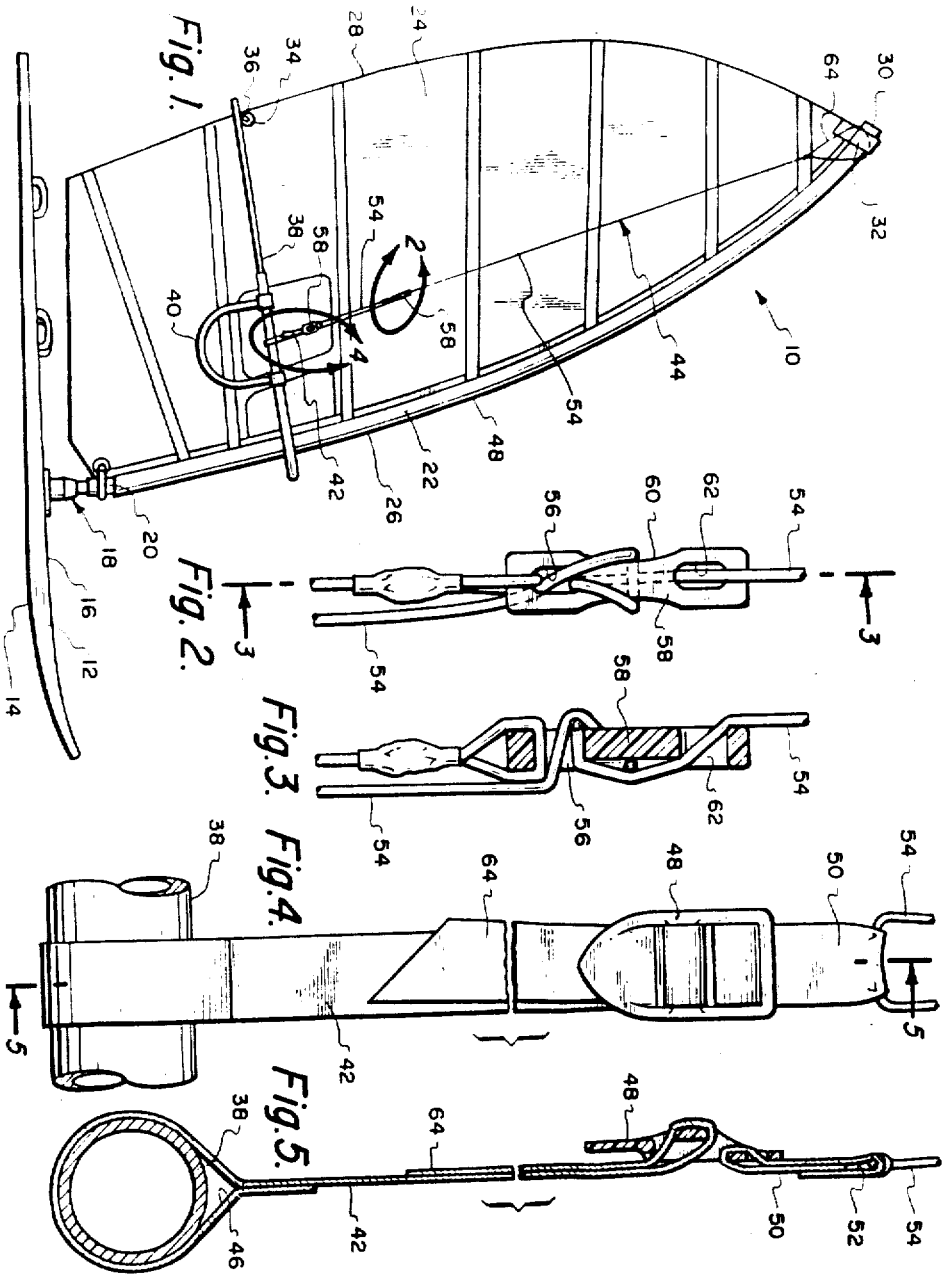
FIG. 1 is a side elevational view of a windsurfer upon which is installed the mast brace of the present invention.
FIG. 2 is an enlarged view of the line adjuster incorporated within the mast brace of the present invention.
FIG. 3 is a cross-sectional view through the line adjuster taken along line 3—3 of FIG. 2.
FIG. 4 is an enlarged view of the buckle assembly which is incorporated within the mast brace of the present invention.
FIG. 5 is a cross-sectional view through the buckle assembly taken along line 5—5 of FIG. 4.

When the mast brace 44 is initially installed, the line adjuster 58 is utilized to establish the initial desired length of the mast brace 44. In other words, the length of the mast brace is selected so that the loop 48 can be installed in position about the boom 38 and the mast brace 44 will assume a non-taut position. Now, when the sailor pulls on outer end 64 of the buckle 42, the cord 54 of the mast brace 44 will become taut. When the sail body 24 encounters wind and billows, the mast 20 will have a tendency to pivot laterally or pivot in a direction into the plane of the paper of FIG. 1 of the drawing. The more taut the cord 54 the less pivoting of the mast 20.

It is to be understood that in actual practice, there very well may be mast brace 44 installed on each side of the sail body 24 with therebeing two such mast braces 44 for each windsurfer 10. It is to be understood that the term "cord" is to include all forms of line such as rope (natural and synthetic), wire and cable.

What is claimed is:

1. In combination with a windsurfer, said windsurfer having a sailboard, a mast mounted on said sailboard, a sail body mounted on said mast, said mast having a free outer end defined as a tip, a boom mounted on said mast and said sail body, said boom extending between the luff edge and the leech edge of said sail body, said mast being mounted at said luff edge, said boom being located nearer said sailboard and said tip, said boom being spaced from said sailboard, said sail body comprising flexible sheet material, said boom being rigid, the improvement comprising:

a mast brace having an upper end and a lower end, said mast brace being constructed principally of cord, said upper end being attached to said mast at said tip, said lower end being attached to said boom in between said luff edge and said leech edge, said mast brace being taut, said mast brace functioning to limit lateral movement of said mast which is caused by wind pressure being applied to said sail body;

said mast brace including a line adjuster mounted between said upper end and said lower end, said line adjuster permitting initial adjusting of the overall length of said mast brace; and said mast brace including a buckle assembly, said buckle assembly being spaced from said line adjuster, said buckle assembly being manually adjustable to vary the tautness of said mast brace, the adjustment of said mast brace by said buckle assembly capable of occurring quickly when needed during operation of said windsurfer.

2. The combination as defined in claim 1 wherein:

a handle, said handle being bifurcated forming a pair of legs, said legs being pivotally mounted to said boom, said lower end of said mast brace being mounted between said pair of legs.

* * * * *

UNITED STATES PATENT AND TRADEMARK OFFICE

CERTIFICATE OF CORRECTION

PATENT NO. : 5,001,999

DATED : 3/15/90

INVENTOR(S) : Vincent A. Morrelli

It is certified that error appears in the above-indentified patent and that said Letters Patent is hereby corrected as shown below:

The drawing sheet consisting of Figs. 7A-7G, should be deleted to be replaced with drawings sheet, consisting of Fig.1-5, as shown on the attached page.

Signed and Sealed this

Fourteenth Day of June, 1994

Bruce Lehman

*Attest:*

BRUCE LEHMAN

*Attesting Officer*

*Commissioner of Patents and Trademarks*